United States Patent [19]

Whitehead et al.

[11] 4,173,424

[45] Nov. 6, 1979

[54] AUTOMATIC PACKING SYSTEM FOR REFUSE VEHICLE

[75] Inventors: James S. Whitehead, Rockdale, Tex.; Thomas M. Lawson, Knoxville, Tenn.

[73] Assignee: Carrier Corporation, Syracuse, N.Y.

[21] Appl. No.: 760,897

[22] Filed: Jan. 21, 1977

[51] Int. Cl.[2] ..... B65F 3/14; B65F 3/20

[52] U.S. Cl. ..... 414/517; 100/51

[58] Field of Search ..... 214/82, 83.3; 100/51

[56] References Cited

U.S. PATENT DOCUMENTS

| | | | |
|---|---|---|---|
| 3,049,256 | 8/1962 | Urban | 214/82 X |
| 3,229,618 | 1/1966 | O'Connor, Jr. | 214/82 X |
| 3,556,324 | 1/1971 | McCarthy | 214/82 |
| 3,831,789 | 8/1974 | Brewer | 214/82 |
| 3,938,433 | 2/1976 | Borum | 100/51 |
| 3,962,964 | 6/1976 | Engebretsen | 100/51 |
| 3,988,979 | 11/1976 | Smith | 214/82 |

*Primary Examiner*—Robert G. Sheridan
*Assistant Examiner*—Lawrence E. Williams
*Attorney, Agent, or Firm*—J. Raymond Curtin; Donald F. Daley; John S. Sensny

[57] ABSTRACT

This invention relates to improvements in compaction bodies of the type used for the collection of refuse, garbage, and the like, and having means therein for compacting such refuse during collection and for discharge therefrom. The invention relates specifically to automatic controls to regulate the operation of a compaction head located inside the compaction body for compacting material therein.

4 Claims, 3 Drawing Figures

AUTOMATIC PACKING SYSTEM FOR REFUSE VEHICLE

BACKGROUND OF THE INVENTION

Compaction bodies are usually mounted on vehicles and are provided with a compaction head or packer plate mounted in the body. The compaction head extends across the body and is movable lengthwise of the body for periodically compressing the material into the rear portion of the body as the material is collected. When the vehicle reaches the dumping site the material may be ejected or removed from the body by operation of the compaction head. The compaction head may be moved throughout the major portion of the length of the body and to varying degrees therein during the compaction action depending on the amount of material in the body. The head is normally located at the front portion of the compaction body when it is not in use. During discharge of material from the compaction body, the compaction head moves to the full extent to the rear of the compaction body.

In manual operation of vehicles of this type, the operator of the vehicle determines when it is desirable to compact or compress the material within the body. He manually initiates operation of the compaction head by movement of a hydraulic valve to provide fluid under pressure to a hydraulic cylinder which drives the head towards the rear of the body. When the compaction head reaches the point that the material is being compressed within the body, the operator then initiates a return stroke of the cylinder to return the compaction head towards its original position at the front of the compaction body. The degree of compaction of material within the compaction body determines the amount of material or payload that can be handled. Increasing the amount of compaction reduces the number of trips required by the vehicle between the point where the trash is collected and the dumping site where the material is discharged. The degree of compaction is related not only to the compaction pressure but also to the length of time the material is held under pressure. By holding the compaction head under pressure against the compacted material, the material will hold its compacted form to a higher degree than if the pressure is released without the holding period. With manual operation of the compaction head, the degree of compaction will vary from load to load and within a single load. To achieve consistent loading under manual operation, requires operator's attention which could be applied to other responsibilities, for example driving the vehicle to next location where refuse is to be collected.

Automatic operation of a packer head is difficult because of the varying length of travel of the compaction head and the need to manually interrupt a compaction cycle under various conditions. Mechanical limit switchers are not suitable for use in controlling the forward movement of the compaction head since refuse in the body would interfere with the operation of the switcher and the degree of movement will be different depending on the amount of refuse.

It is an object of this invention to improve operation of compaction bodies to provide better, more consistent, compaction of material and to reduce operator time in the compaction operation.

It is a further object of this invention to automate the operation of compaction heads in refuse compaction bodies.

It is a further object of this invention to provide automatic circuitry for the operation of compaction heads in refuse compaction bodies.

SUMMARY OF THE INVENTION

These and other objects of this invention are attained by use of electrical circuitry which utilizes pressure sensitive switches in the hydraulic lines to the hydraulic cylinder of a compaction head in a refuse compaction body to control the length of stroke of the compaction head and an electrical timer to control the time that the compaction head holds pressure against the material being compacted. Overriding manual controls are provided to interrupt the automatic cycle at any point and to discharge material from the compaction body.

BRIEF DESCRIPTION OF THE DRAWINGS

The preferred embodiment of this invention is illustrated in the accompanying drawings in which.

DESCRIPTION OF THE PREFERRED EMBODIMENT

Figure 1:
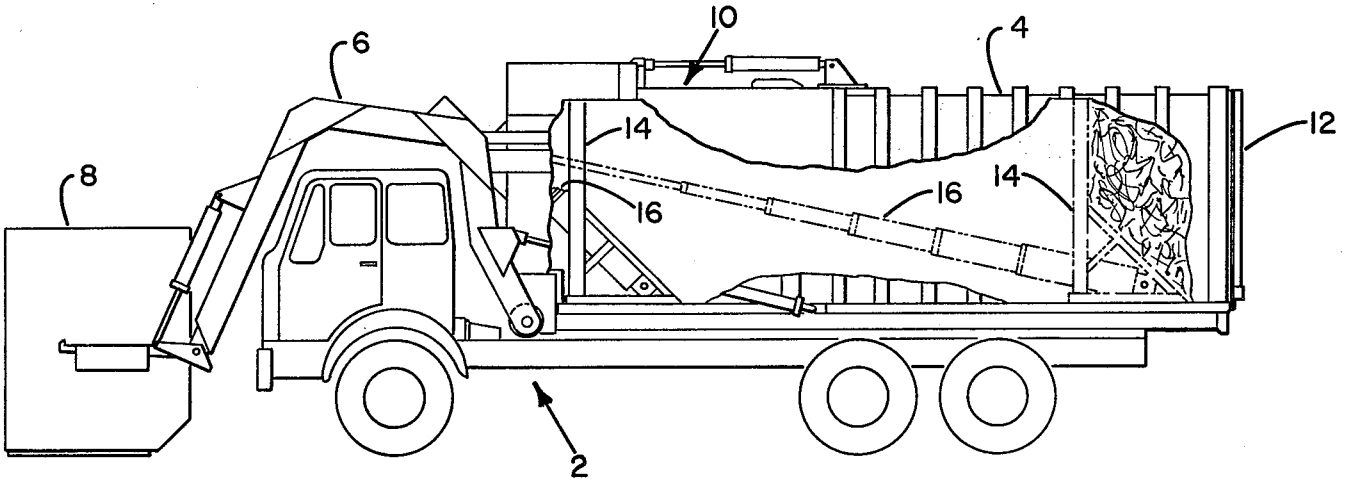
FIG. 1 is a side view of a front loading refuse collection vehicle having a compaction body with portions broken away to show internal structure.

Referring to FIG. 1 of the drawings, there is shown a refuse collection vehicle 2 of the front loading type having a compaction body 4. A pair of loading arms 6 extend over the cab of the vehicle to a position in front of the vehicle. The loading arms are adapted to engage a refuse container 8, lift the container over the compaction body 4 and dump the container into the compaction body through an opening designated generally at 10. At the rear of the compaction body there is a large discharge door 12 through which material may be discharged from the body. Within the compaction body 4 there is a compaction head 14 which extends across the width of the body and which is movable back and forth through the length of the body. The term front is used herein to designate that portion of the compaction body towards the front, or cab, of the vehicle and the term rear is used to designate that portion towards the rear of the vehicle. In reference to the compaction head, the terms front and rear designate that face of the compaction head which faces the front and rear of the vehicle.

A hydraulic packing cylinder 16 is secured within the compaction body 4 with one end secured to the front wall of the compaction body and the other end secured to the front face of the compaction head 14. Extension and retraction of the hydraulic cylinder will move the compaction head 14 rearwardly and forwardly through the compaction body. The normal refuse loading position of the compaction head is shown in solid lines at the front of the compaction body. The loading opening 10 is rearwardly of the compaction head so that material or refuse which is deposited in the body through opening 10 will accumulate to the rear of the compaction head. When the cylinder 16 is extended the compaction head 14 is moved rearwardly, to the position shown in dotted lines, compacting the refuse material against the rear of the compaction body. When the compaction body is loaded or when it is designed to remove material from the compaction body, the discharge door 12 is opened and the cylinder 16 is extended to its rear most portion. The compaction head 14 forces the material out the discharge door 12 and the compaction head is returned to the forward position.

In order to assure maximum loading of the compaction body, the compaction head 14 should be run through a packing cycle at frequent intervals during refuse loading. This operation normally requires the attention of an operator. It is desirable to be able to perform this operation without the attention of an operator and during periods when the vehicle is being used to transport the compaction body from one location to another. With the present invention, the operator can load refuse at one location and automatically compact the refuse while driving to another location to pick up additional refuse.

Figure 2:
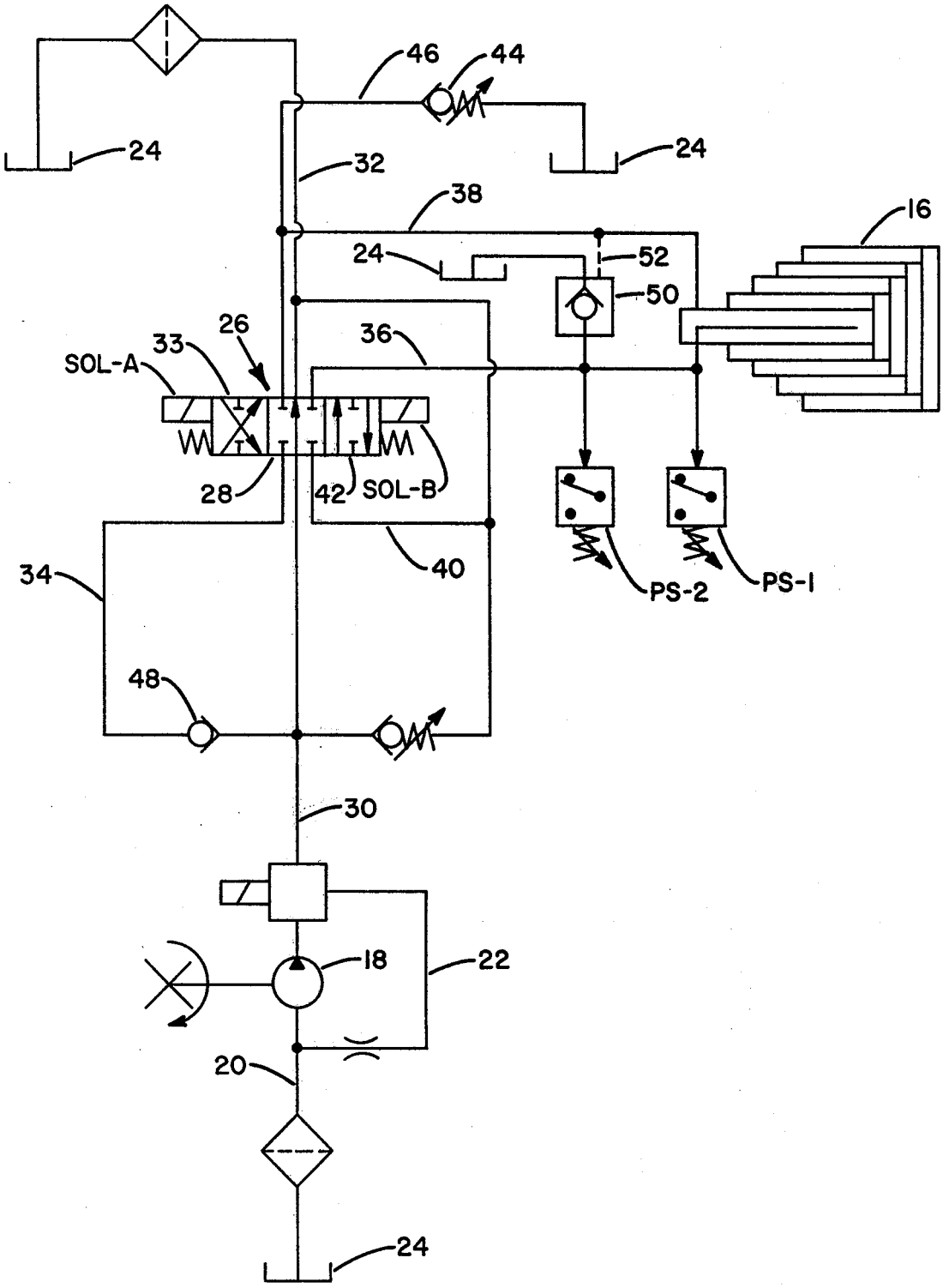
FIG. 2 is a schematic representation of the hydraulic circuitry suitable for use in the present invention.

Referring to FIG. 2 there is shown a schematic diagram of the hydraulic circuitry used to power the hydraulic cylinder 16. Hydraulic fluid under pressure is supplied to the cylinder by a hydraulic fluid pump 18. The pump 18 is of the type which is driven from the vehicle engine and continually pumps fluid during operation of the engine. Excess fluid, is circulated back into the intake line 20 to the pump by means of by-pass line 22. Fluid is supplied to the pump 18 from a reservoir 24 through line 20.

A hydraulic control valve 26 controls the flow of fluid to the head end and cylinder end of the cylinder 16 or back to the reservoir 24. The control valve 26 has three positions: a center or neutral position 28 which takes fluid from pump 18 through line 30 and directs it back to reservoir 24 through line 32; an extended position 33 which takes fluid from pump 18 through line 34 and directs the fluid through line 36 to the head end of the cylinder 16 and accepts fluid from the rod end of cylinder 16 through line 38 and directs it back to the reservoir 24 through line 40, and a retract position 42 which accepts fluid from line 34 and directs it to the rod end of the cylinder 16 through line 38 and accepts fluid from the head end of cylinder 16 through line 36 and directs it to the reservoir 24 through line 40. The control valve 26 is spring loaded to the neutral or center position 28 and is activated to the extend or retract positions 33 and 42 by means of solenoids Sol-A and Sol-B respectively. The control valve 26 is shown as being solenoid actuated. It may, however, be actuated by pneumatic means such as an air cylinder which in turn would be controlled by solenoids Sol-A and Sol-B. For simplification and clarity purposes, the valve is shown as directly actuated by solenoids. Modifications to achieve other means of actuating the valve is within the ability of one skilled in the art and is encompassed within the scope of this invention.

Two pressure sensitive switches PS-1 and PS-2 are located within the system to sense hydraulic fluid pressure in line 36 extending between the control valve 26 and the head end of the hydraulic cylinder 16. Switch PS-1 is set to close normally opened electrical contacts when the pressure in line 36 exceeds a preset amount. Switch PS-2 is set to close normally held open electrical contacts if the pressure in line 36 drops below a preset amount. The actual preset pressure of each switch would be determined from actual installation requirements, such as the type or material to be loaded and the type and size of the hydraulic cylinder. The function of the electrical contacts on each of the pressure switches are described more fully below with regard to the electrical circuit. To prevent excessive pressure buildup in hydraulic fluid line 38 extending from the control valve 26 to the rod end of cylinder 16, there is a fluid line 46 extending to the reservoir 24, and having relief valve 44 mounted therein. The relief valve is set to divert hydraulic fluid to the reservoir if the pressure in line 38 exceeds a preset amount. In addition, a check valve 48 is mounted in the line 34 to the control valve 26 to prevent any back flow of hydraulic fluid from lines 36 and 38. A pilot controlled check valve 50 is connected to line 36 extending from the control valve 26 to the head end of cylinder 16 to direct fluid from line 36 to the reservoir 24. The pressure at which valve 50 will release is determined by the pressure in line 38 at the time by means of pilot line 52 extending from line 38 to the valve 50.

Figure 3:
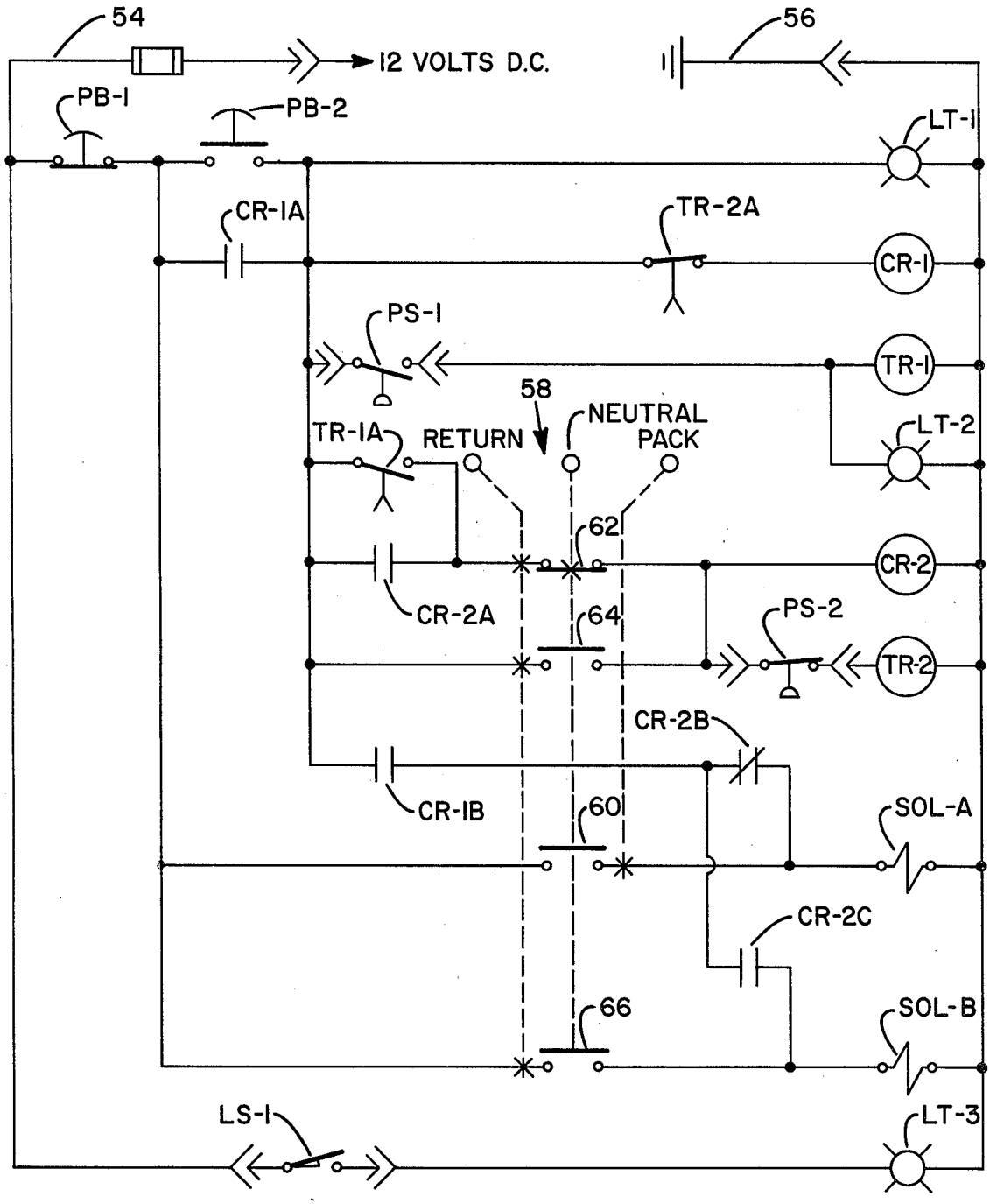
FIG. 3 is a schematic representation of electrical circuitry suitable for use in the present invention.

FIG. 3 shows a schematic diagram of the electrical circuitry to be used in conjunction with the hydraulic system shown in FIG. 2. The entire circuit is connected to a 12 volt d.c. electrical source, as found in vehicles of the type disclosed herein, by line 54, and to ground by line 56. The circuit includes a manually operated cycle switch PB-2, a manually operated stop cycle switch PB-1 and a series of indicator lights, all of which are normally located within the cab of the vehicle for access and observance by the operator or driver of the vehicle. The pressure switches PS-1 and PS-2, located in the hydraulic system as described above, and the solenoids Sol-A and Sol-B, associated with the control valve 26, are also connected in the electrical circuit.

The electrical circuitry in operation of the automatic packer cycle functions in the following manner. The operator of the vehicle presses the automatic cycle button PB-2 located on the control panel on the cab of the vehicle. At any time that he desires to stop the automatic operation of the compaction head 14, he can depress the stop cycle switch PB-1 also located on the control panel in the cab of the vehicle. By closing of the switch PB-2, the automatic packing cycle is energized and the light LT-1 is illuminated on the control panel indicating that the compaction head 14 is in an automatic mode of operation. A relay CR-1, which has two normally open contacts CR-1A and CR-1B, is energized. Energization of the relay CR-1 closes the contact CR-1A providing a holding circuit for the relay, and closes the contact CR-1B energizing advance packer solenoid Sol-A. The solenoid Sol-A causes control valve 26 shown in FIG. 2 to move to the right or the extend position. The hydraulic cylinder 16 is caused to advance moving the compaction head 14 towards the rear of the compaction body 4.

As the compaction head engages refuse material in the compaction body 4, the pressure in the hydraulic line 36 will increase until the preset pressure in pressure switch PS-1 is exceeded. Contacts for switch PS-1 as seen in FIG. 3 will close energizing timer TR-1 and illuminating indicator light LT-2 on the control panel. Light LT-2 indicates to the operator that the system is in a hold mode of operation. The timer TR-1 is a variable setting timer device which can be set for a time period usually between 4 to 7 seconds for actuating and closing a pair of contacts TR-1A. The purpose of timer TR-1 is to hold the compaction head 14 under pressure against the refuse material to thereby aid in compaction of that material. It is established that holding material under pressure for a period of time provides better, more consistent packing than merely applying the pressure and immediately releasing it.

When a preset time on the timer TR-1 expires, the contacts TR-1A closes a circuit to second relay CR-2 and a second timer TR-2. Energization of the relay CR-2 closes its first set of normally opened contacts CR-2A to provide a holding circuit for the relay when the contacts TR-1A are released. Energization of the relay CR-2 causes the normally closed contacts CR-2B located in the circuit to the advance packer solenoid Sol-A to open cutting off power to the solenoid. In addition, the normally opened contacts CR-2C located in the circuit to return packer solenoid Sol-B are closed energizing the solenoid. With the solenoid Sol-A de-energized and the solenoid Sol-B energized, the hydraulic valve 26 is moved from the extend position 33 to the retract position 42 shown in FIG. 2. The hydraulic cylinder 16 is then retracted by high pressure fluid in line 38. The pressure in line 36 drops opening the contacts of pressure switch PS-1. As the cylinder 16 retracts, the compaction head 14 is returned to the front of the compaction body 4. Opening the contacts of pressure switch PS-1 de-energizes the timer TR-1 and the indicator light LT-2 on the control panel. The complete return of the compaction head 14 to its original position will be indicated by a sharp drop in pressure in the line 36. The contacts for the low pressure switch PS-2 are intended to signal completion of the cycle, returning the cycle to its original starting positions. As the hydraulic cylinder 16 may be a multistage telescopic cylinder there is a possibility of sharp pressure drops as various stages of the cylinder are actuated. To prevent the circuit from being de-energized as a result of such pressure drops, the normally closed contacts of pressure switch PS-2 are placed in the circuit to timer TR-2. The normally closed contacts of TR-2A and timer TR-2 are placed in the circuit to the relay CR-1. In this manner, the timer TR-2 which is normally set to open the contacts TR-2A approximately 3 seconds after the timer TR-2 is energized will hold the circuit to relay CR-1 closed even though the contacts of the pressure PS-2 may be momentarily closed applying power to the timer. As pressure in line 36 rises again to a point above the actuating point of the switch PS-2, the contacts for the switch are opened de-energizing timer TR-2 and holding contacts TR-2A in a closed position. When the compaction head 14 reaches its return position, the pressure in line 36 drops to a point where the contacts of pressure switch PS-2 are closed and after the expiration of the time delay set in timer TR-2, the contacts TR-2A are opened de-energizing relay CR-1. De-energizing of relay CR-1 causes the contacts CR-1A to open cutting off power to the return packer solenoid Sol-B allowing the control valve 26 to return to the neutral or center position 28. In addition, since the automatic cycle switch PB-2 is in an open position, the opening of contacts CR-1A cuts off the entire power supply to the automatic cycle circuit.

The return of the compaction head 14 to its original position actuates a limit switch LS-1 located in the compaction body 4 front of the compaction head and in a portion of the electrical circuitry which bypasses the automatic cycle valve and the contacts CR-1A. Actuation of the limit switch LS-1 turns off signal light LT-3 on the control panel indicating that the packer has returned to its original position. If for any reason, the compaction head jammed or has not returned to its original position, the limit switch LS-1 will not be actuated and the signal light LT-3 will be illuminated on the panel. Thus, the operator can determine whether or not the compaction head is in the position wherein he can load additional refuse material in the compaction body 4.

A manually control handle indicated as 58 in FIG. 3 is also mounted either on the control panel within the cab of the vehicle or on the side of the vehicle for manual actuation of the compaction head 14 during any portion of the automatic cycle or without actuation of the automatic cycle. As seen in FIG. 3, the manual control handle has three positions. There is a neutral position wherein the compaction head is not under the control of the manual control handle switch 62 is closed in neutral. There is a pack position wherein a switch 60 in the circuit to the solenoid Sol-A may be closed energizing the solenoid and causing the compaction head 14 to move towards the rear of the compaction body 4 switches 62, 64 and 66 are opened. The third position is the return position. In the return position the handle holds a switch 62 closed in the line to the relay CR-2, closes a switch 64 in the circuit to the timer TR-2 and closes a switch 66 in a circuit to the return packer solenoid Sol-B. With the switch 66 closed, the solenoid Sol-B is energized and control valve 26 moves to the retract position 42 thus causing the compaction head 14 to move towards the front of the compaction body 4. Moving the handle 58 to either the pack or the return position places the movement of the compaction head 14 completely within the control of the operator independent of whether or not the automatic cycle switch has been activated. The system as described is operable in the automatic cycle without the control handle 58, or in an automatic or manual cycle with the control handle 58.

As is evident from the foregoing description, certain aspects of the invention are not limited to the particular details or construction of the example illustrated, and it is contemplated that various other modifications or applications will occur to those skilled in the art. It is, therefore, intended that the appended claims cover such modifications and applications as do not depart from the true spirit and scope of the invention.

What is claimed is:

1. An automatic packing mechanism for refuse compaction bodies including:

a compaction head inside the compaction body and extending across the compaction body, an hydraulic cylinder connected to said compaction head and to the front of the compaction body, hydraulic fluid circuit means connected to the hydraulic cylinder so that pressurized hydraulic fluid can flow to and from the hydraulic cylinder to extend and retract the hydraulic cylinder to thereby move the compaction head longitudinally back and forth within the compaction body, hydraulic cylinder control means including:

(a) a control valve in the fluid circuit means having a first position to direct fluid to the hydraulic cylinder to cause the cylinder to extend and advance the compaction head rearwardly through the compaction body and a second position to direct fluid to the hydraulic cylinder to cause the cylinder to retract and to return the compaction head back to the front of the compaction body.

(b) an advance solenoid and a return solenoid operatively associated with the control valve to move the valve to the first position and second position respectively upon energization of each solenoid, electrical circuitry connected to the advance and return solenoids including:

(a) means to energize the advance solenoid (b) a first pressure sensitive switch positioned in the hydraulic fluid circuit means to sense hydraulic fluid pressure and to close electrical contacts when the fluid directed to the hydraulic cylinder to extend the cylinder reaches a preset pressure, (c) a first electrical timer positioned electrically in series with the first pressure switch whereby said timer is activated when fluid to the hydraulic cylinder reaches the preset pressure, (d) electrical contact means associated with the first electric timer to de-energize the advance solenoid and to energize the return solenoid to thereby return the compaction head to the front of the compaction body after the first electric timer has been activated for a preset, relatively short length of time, (e) a second pressure sensitive switch positioned in the hydraulic fluid circuit means to sense hydraulic fluid pressure and to de-energize the return solenoid when the pressure of fluid from the hydraulic cylinder as the cylinder retracts drops below a preset low pressure level.

2. The automatic packing mechanism of claim 1 further including overriding manual controls connected in said electrical circuitry to energize said advance solenoid and said return solenoid at any time.

3. The automatic packing mechanism of claim 1 wherein the electrical circuitry further includes, (f) a second electrical timer positioned electrically in series with the second pressure switch whereby said second timer is activated when the pressure of fluid from the hydraulic cylinder as the cylinder retracts drops below the preset low pressure level, and (g) second electrical contact means associated with the second electrical timer to maintain the return solenoid in an energized state for a period of time after the pressure of fluid from the hydraulic cylinder as the cylinder retracts drops below the preset low pressure level.

4. The automatic packing mechanism of claim 3 wherein the preset, relatively short length of time is four to seven seconds.

* * * * *